US005709045A

United States Patent [19]

Thelen

[11] Patent Number: 5,709,045

[45] Date of Patent: Jan. 20, 1998

[54] ELECTROLUMINESCENT IDENTIFICATION DEVICE

[76] Inventor: Brian L. Thelen, W.3904 Artesian Rd., Fond du Lac, Wis. 54935

[21] Appl. No.: 633,229

[22] Filed: Apr. 16, 1996

Related U.S. Application Data

[63] Continuation-in-part of Ser. No. 323,806, Oct. 17, 1994, abandoned.

[51] Int. Cl.[6] ..... G09F 13/22

[52] U.S. Cl. ..... 40/544; 362/812

[58] Field of Search ..... 313/510, 513; 363/8; 40/544, 451; 362/84, 812

[56] References Cited

U.S. PATENT DOCUMENTS

| | | | |
|---|---|---|---|
| 2,867,739 | 1/1959 | Michlin | 40/544 |
| 3,083,317 | 3/1963 | Fish et al. | 40/544 X |
| 3,188,761 | 6/1965 | Harrold | 40/544 |
| 3,212,080 | 10/1965 | Gurian et al. | 40/544 X |
| 3,678,367 | 7/1972 | McMurray | 363/9 X |
| 3,680,237 | 8/1972 | Finnerty, Sr. . | |
| 3,913,004 | 10/1975 | Alexander | 363/102 X |
| 4,138,620 | 2/1979 | Dickson . | |
| 4,250,645 | 2/1981 | Ariga | 40/545 |
| 4,327,511 | 5/1982 | Rodriguez | 40/544 |
| 4,525,774 | 6/1985 | Kino et al. | 363/17 |
| 4,587,597 | 5/1986 | Meyers . | |
| 5,143,285 | 9/1992 | Wise . | |
| 5,272,612 | 12/1993 | Harada et al. | 363/8 |

OTHER PUBLICATIONS

Introduction to Electrical Engineering; Paul, Nasar and Unnewehr; 1986; p. 598.

*Primary Examiner*—Joanne Silbermann

*Attorney, Agent, or Firm*—Andrus, Sceales, Starke & Sawall

[57] ABSTRACT

An electroluminescent identification device includes an enclosure which supports a variety of opaque alpha-numeric characters, a luminescent lamp which highlights the characters, and an electronic circuit which converts the alternating voltage typically used in doorbell electrical circuits to the higher alternating frequencies required to energize the lamp.

6 Claims, 4 Drawing Sheets

ELECTROLUMINESCENT IDENTIFICATION DEVICE

This is a continuation-in-part of application Ser. No. 08/323,806 filed Oct. 17, 1994, now abandoned.

BACKGROUND OF THE INVENTION

Most people have had the difficult experience of seeking an unknown house address in darkness. In many situations the house numbers are not visible, even when exterior lights are illuminated. This same exacting situation exists for emergency service people, such as doctors, firemen, paramedics, police, etc., as well. The location requesting help is totally dependent on the emergency unit to find them. In the event that a threatening situation requires a stealthy approach by a sheriff or the police, the typical use of a spotlight might easily be counterproductive.

This device makes it possible for its owner to take a proactive role in being located. The invention requires no explicit action on the owner's part to be effective. It is a unit well-suited to the "911" services growing within our society.

The character of the lamp is such that it requires very little power and has a long life, even under the harsh extremes of weather conditions found within the United States. The device is connected to a low voltage supply source such as a "doorbell" transformer, and is lighted continuously. The lighting characteristics of the lamp are such that daylight overcomes the illumination level provided, and its light color under daylight conditions provides a high contrast background for the identification numbers. At night it produces a highly uniform soft glow which is exceptionally visible. The size of the backlighted characters (i.e., height, width and stroke) establish the readable distance. The object of this device is to provide assurance of being easily located, even under unfavorable lighting conditions.

SUMMARY OF THE INVENTION

The device is mounted to the vertical surface of a building in a position most easily visible from the approach road. It is connected to the building's low voltage power supply, for example, a typical doorbell circuit. This power is converted to a low voltage direct current using a full wave bridge rectifier. This energy is then converted using an inverter to a higher voltage, higher frequency which energizes the capacitive characteristic electroluminescent lamp. The lamp provides a planer background for black or darkly colored opaque numbers/letters, backlighting them when in darkness. Once in place, it provides a continuously lighted identification address, which is highly visible at night. The enclosure is arranged to support the requisite electronic circuit, the lamp and a protective transparent face plate. Since each building address is a unique set of alpha-numeric characters, a series of pre-cut grid self-adhesive 5×7 matrixes is provided allowing the occupier to create a specific character set. Conventional opaque characters may alternately be used, being fastened to the face plate with a variety of suitable fastenings.

BRIEF DESCRIPTION OF THE DRAWING

For the purpose of illustrating the invention, there is shown in the accompanying drawings a form thereof which is at present preferred, although it is to be understood that the several instrumentalities of which the invention exists can be variously arranged and organized and that the invention is not limited to the precise arrangements and organizations of the instrumentalities as herein shown and described.

In the drawings, wherein like reference characters indicate like parts:

Referring now to FIG. 1, a housing 1 is an extrusion of suitable material which supports and protects the components. End closures 6 provide protection for the internal elements from the weather, and are fastened with mechanical fasteners 7 to the housing 1. The face 5 is a clear face plate of glass or plastic providing protection for the interior circuit and lamp, and a mounting surface for the alphanumeric characters which spell out an identifying number 4.

In FIG. 2, a power circuit 2 is supported within the unit by the housing's mounting slots. A thin-plane electroluminescent lamp 3 is supported by a stiffening panel or slats 9 to maintain the plane of the lamp. A gap 8 between the lamp 3 and the clear face plate 5 allows drainage of invasive water through weep slots 11.

FIGS. 3*a* and 3*b* are electrical schematic drawings of an illuminated premises identification system in accordance with the invention. FIGS. 3*a* and 3*b* show an annunciator circuit comprising a doorbell transformer 12 and a conventional push-button annunciator 13. FIGS. 3*a* and 3*b* also show a converter 2 that converts low voltage, low frequency power to higher voltage, higher frequency output power in the range of 80–150 volts, at 300–500 Hz, with a total power consumption of less than 10 watts. The higher voltage, higher frequency power is used to illuminate the electroluminescent lamp 3. The converter 2 is electrically connected to the bell transformer 12 in parallel to the annunciator circuit as depicted by electrical junction 14.

FIG. 3*a* shows a jumper 15 connected for low input voltage (e.g. 8 to 12 AC volts). FIG. 3*b* shows the jumper 15 connected for high input voltage (e.g. 12 to 20 AC volts).

FIG. 4 is a front view of the device.

Figure 1:
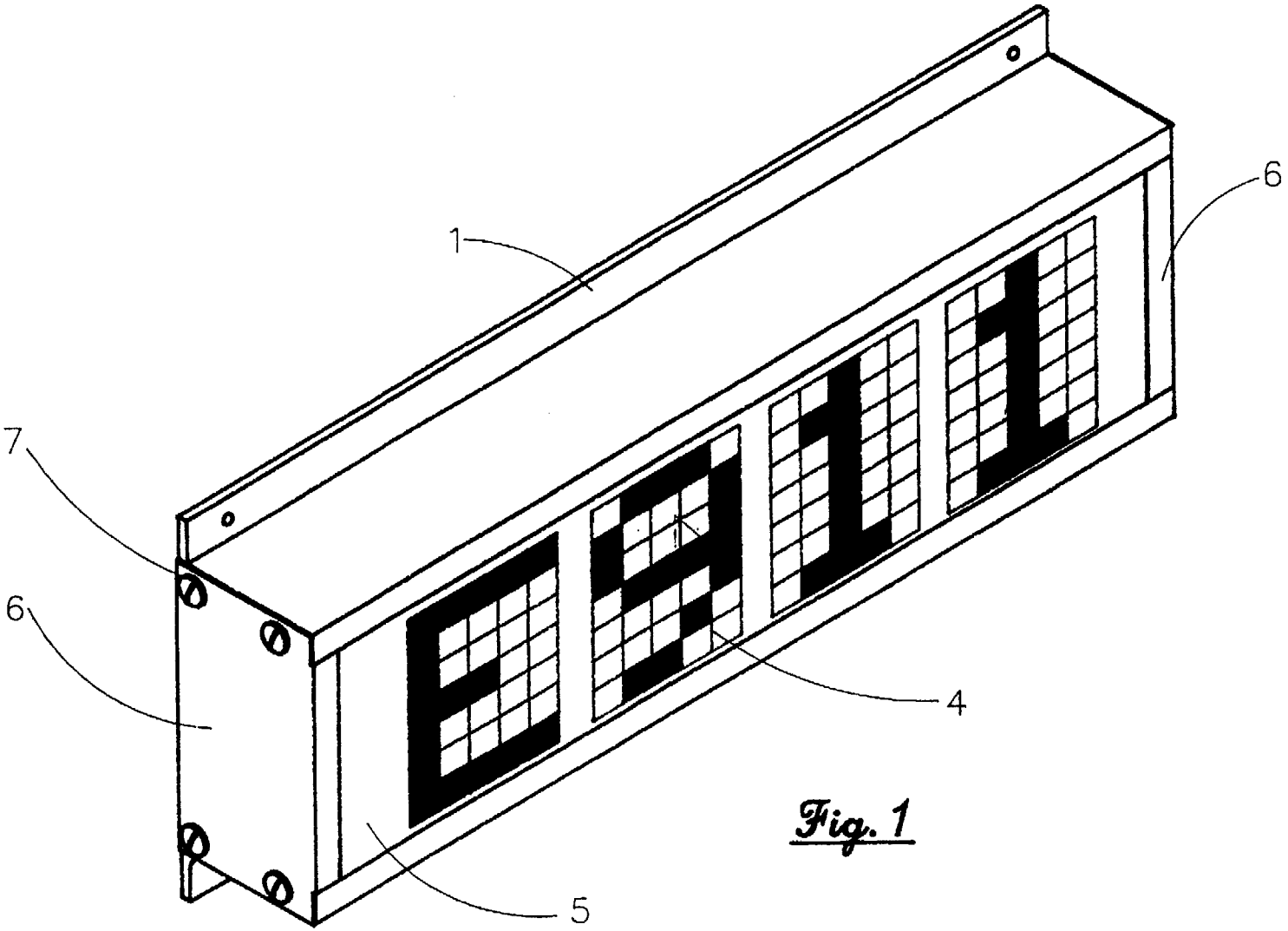
FIG. 1 is an isometric view generally showing the front, an end and the top view of the overall device.
Figure 2:
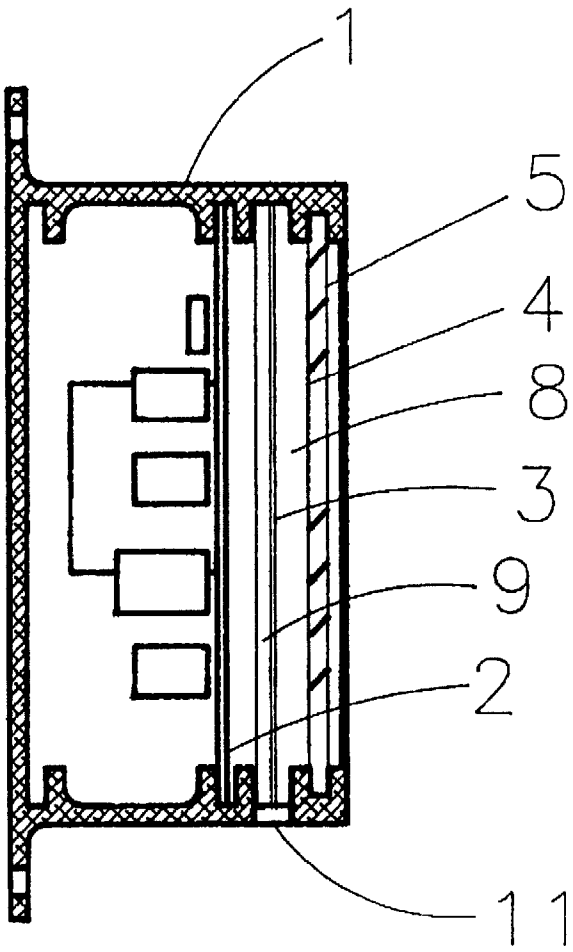
FIG. 2 is a sectional view along line 2—2 of FIG. 4.
Figure 3A:
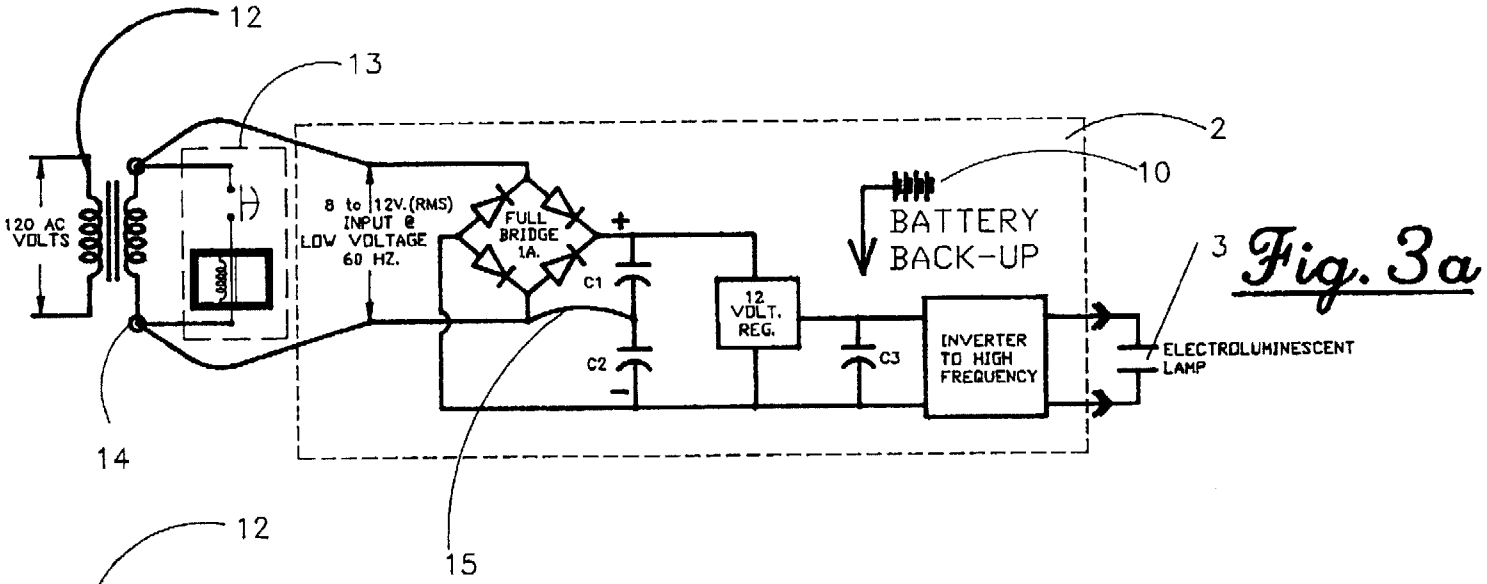
FIGS. 3*a* and 3*b* are schematic drawings showing an illuminated premises identification system in accordance with the invention including a circuit incorporated to provide alternating voltage at the higher frequency required by the electroluminescent lamp.
Figure 3B:
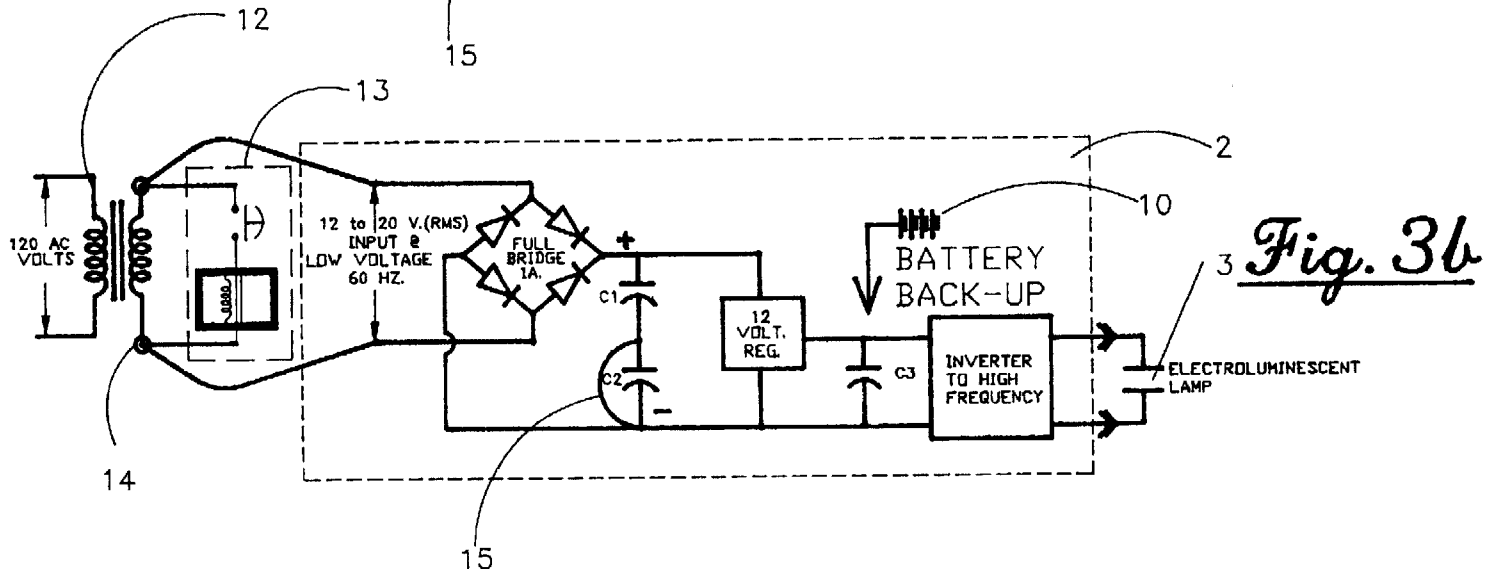
Figure 4:
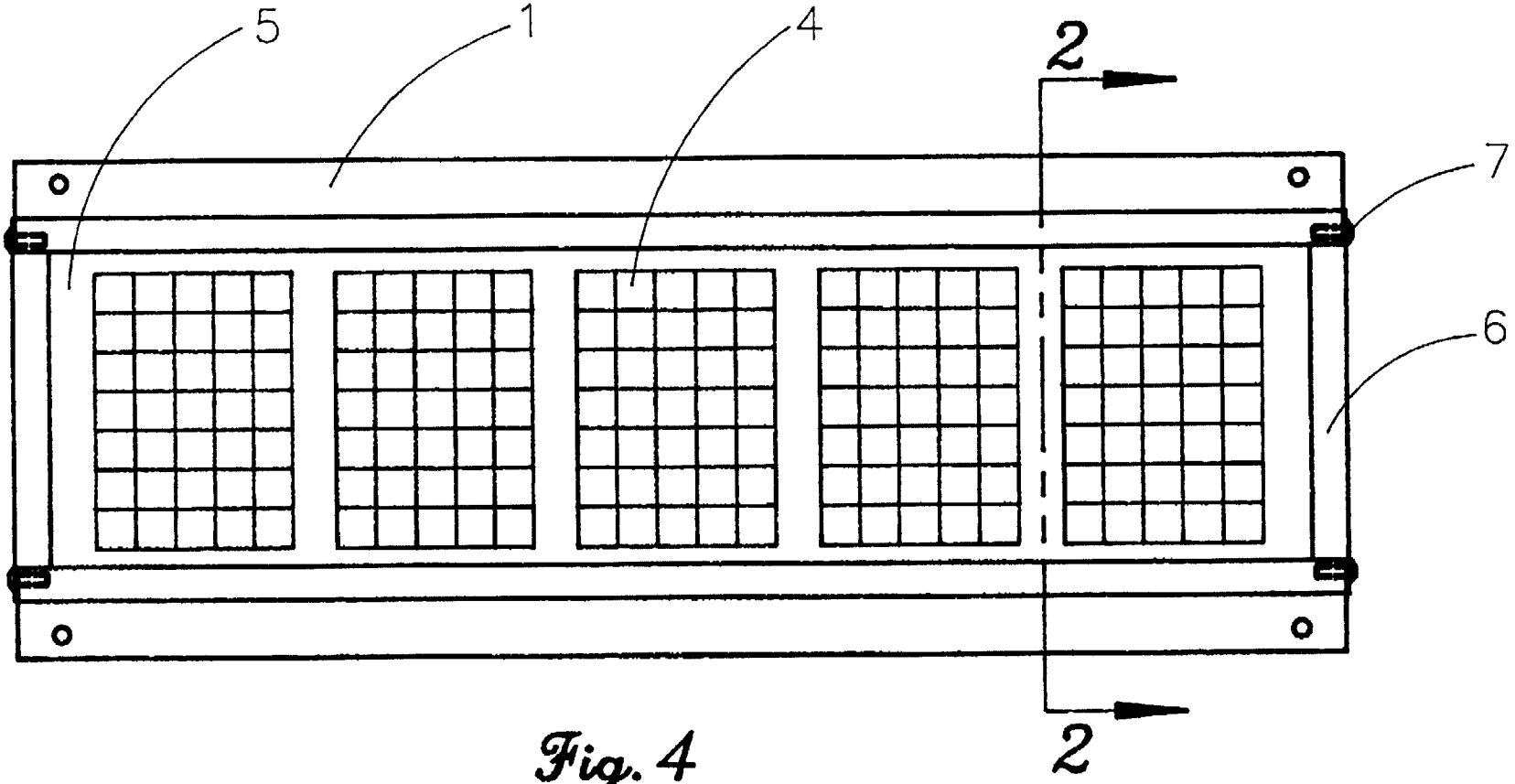
FIG. 4 is a frontal view of the unit showing the alphanumeric 5×7 matrix positions for a 5 character unit.

Thus it can be seen that the present invention includes four principle features:

1. The implementation of a lighting panel to provide uniform backlighting of identification numbers for maximum legibility in darkness.

2. A power supply circuit utilizing low voltage readily available in most buildings.

3. The capability of augmenting the power supply to provide an illuminated identification in the event of power loss.

4. An alpha-numeric matrix scheme allowing for any desired identification number to be formulated from adhesive backed opaque material, which is also legible under daylight conditions.

It is to be understood that the present invention may be embodied in other specific forms without departing from the spirit or special attributes hereof, and it is, therefore, desired that the present embodiments be considered in all respects as illustrative, and therefore, not restrictive, reference being made to the appended claims rather than to the foregoing description to indicate the scope of the invention.

I claim:

1. An illuminated premises identification system comprising:

an annunciator circuit including a doorbell transformer and an annunciator; and an electroluminescent identifying device including low-voltage, low-frequency power from the doorbell transformer providing a voltage in the range of 8 to 20 A.C. volts, at 50 to 60 Hertz, a converter for changing the low-voltage, low-frequency power to higher-voltage, higher-frequency output power in the range of 80 to 150 volts, at 300 to 500 Hertz, with a total power consumption of less than 10 watts, the convertor connected to the annunciator circuit in parallel to the annunciator so neither device interferes with the operation of the other, a capacitive load characteristic lamp, and passive/opaque material in the form of alpha-numeric characters which form a cumulative character unit and which are visually surrounded and back-lighted by said capacitive load characteristic lamp for maximum legibility.

2. The system of claim 1, including a housing to support the alpha-numeric characters.

3. The system of claim 1 capable of displaying the alpha-numeric characters under all ambient light conditions.

4. The system of claim 1 wherein the alpha-numeric characters are building identifiers and which characters have a minimum height of 4 inches (101.6 mm) and have a minimal stroke of ½ inch (12.7 mm).

5. The system of claim 1 wherein the capacitive load characteristic lamp is located behind the alpha-numeric characters and the lamp is larger in height and width than the cumulative character unit, thus outlining each opaque alpha-numeric character for maximum sharp contrast and legibility whereby it acts as a visual magnet, drawing the human eye to its position.

6. A system as recited in claim 1 wherein the converter has switchable input voltage ranges of either 8 to 12 alternating current volts, or 12 to 20 alternating current volts.

* * * * *